United States Patent [19]

Bobrowski

[11] 4,318,486

[45] Mar. 9, 1982

[54] WALL STORAGE SYSTEM

[75] Inventor: Louis G. Bobrowski, Berlin, Conn.

[73] Assignee: The Stanley Works, New Britain, Conn.

[21] Appl. No.: 8,577

[22] Filed: Feb. 1, 1979

Related U.S. Application Data

[63] Continuation of Ser. No. 830,108, Sep. 2, 1977, abandoned.

[51] Int. Cl.[3] ..... A47F 5/08

[52] U.S. Cl. ..... 211/87; 248/215

[58] Field of Search ..... 211/87, 123, 124, 94, 211/4, 7, 60 T; 248/215, 214

[56] References Cited

U.S. PATENT DOCUMENTS

| | | | |
|---|---|---|---|
| 46,528 | 2/1865 | MacFerran et al. . | |
| 167,620 | 9/1875 | Richards | 248/215 |
| 451,270 | 4/1891 | Elten | 248/215 |
| 1,788,722 | 1/1931 | Koebler . | |
| 2,291,966 | 8/1942 | Joseph . | |
| 2,509,336 | 5/1950 | Darby | 211/87 X |
| 2,546,720 | 3/1951 | Brothers | 211/87 |
| 2,577,860 | 12/1951 | Schoor . | |
| 2,643,775 | 6/1953 | Franklin | 211/87 |
| 2,665,869 | 1/1954 | Samuels | 211/87 X |
| 3,138,359 | 6/1964 | Stewart | 211/87 X |

FOREIGN PATENT DOCUMENTS

| | | | |
|---|---|---|---|
| 91159 | 12/1937 | Sweden | 248/215 |
| 247664 | 2/1926 | United Kingdom | 248/215 |

OTHER PUBLICATIONS

Stanley Works Catalogue, p. 212, May, 1969.

Carimac Hang-A-Tool, Marathon Carey-McFall Co. Brochure Page Showing Model No. 8850.

*Primary Examiner*—J. Franklin Foss

*Attorney, Agent, or Firm*—Brumbaugh, Graves, Donohue & Raymond

[57] ABSTRACT

A wall storage system makes use of a support rail horizontally attached to a wall. The rail may be offset from the wall between its ends and has one or more vertical grooves across its width. One or more brackets formed with a U-shaped arm section to support a load are attached to the rail by an inverted U-shaped fastener section. A protrusion at the open end of the fastener causes it to grip the rail and yet permits the bracket to be mounted on the bar at the groove. Once the bracket has been slid along the rail out of the groove area, it is captured on the rail and provides firm support for the load.

8 Claims, 3 Drawing Figures

WALL STORAGE SYSTEM

This is a continuation of application Ser. No. 830,108 filed Sept. 2, 1977 now abandoned.

BACKGROUND OF THE INVENTION

This invention relates to wall storage systems and, more particularly, to wall storage systems that are adjustable to accommodate and store loads having various shapes, sizes and weights.

Wall storage units have included horizontal bars or rails on which are mounted brackets or hooks for supporting various items. Many of these units have hooks permanently attached to specified points on a bar. While this type of system provides good stability, it limits the types of devices that can be stored. Other storage systems permit brackets captured on a rail to be slid therealong. While this provides additional flexibility, it is advantageous to permit the number of slidable brackets to be changed after the rail has been mounted on the wall, thus accommodating the largest number of different devices.

The most common wall storage unit which allows for the changing of slidable brackets after the rail is installed has an open-ended fastener at the back of the bracket, which fastener is merely slipped over the top of the rail. An example of such a system is disclosed in U.S. Pat. No. 3,260,489 to Hentzi. While the Hentzi type of wall storage unit has great flexibility, it is less stable than other units. In particular, the brackets are easily dislodged by an upward motion, such as might occur when a device is removed from the bracket. Also, the brackets tend to wobble in the horizontal plane unless special provisions are made. These provisions increase the material cost and labor involved in manufacturing the system.

Wall storage systems illustrated in U.S. Pat. No. 2,291,966 to Joseph and U.S. Pat. No. 2,546,720 to Brothers overcome some of the problems of the open fastener type bracket. These systems employ brackets with fasteners that are essentially trapped on the rail, but which can be added or removed from the rail by putting the bracket under sufficient stress to pry open the fastener. If the fastener material has the proper amount of resilience, the fastener will snap to its closed position once the bracket is located on the rail. In order to add or remove the brackets without special tools, the fastener sections of the brackets must, however, have substantial resilience. In these circumstances, the bracket may not be as strong as is desirable to support heavy loads, such as power lawn mowers. Therefore, it would be useful to have a wall storage unit with brackets that can be added or removed from a mounting rail attached to a wall and that can be slid along the rail to a desired position, while still having the same strength and stability as brackets that are secured to the rail.

SUMMARY OF THE INVENTION

The present invention provides a wall storage system which is readily adjustable to differently shaped loads and is strong and stable enough to support heavy loads. This object is accomplished by providing a mounting rail carrying brackets with U-shaped fastener sections which grip the rail, but which can be slipped off at one or more grooves in the rail.

In an illustrative embodiment of the invention, the wall storage system includes a horizontal mounting rail adapted to be secured to vertical studs of the wall. Attaching regions of the rail have apertures for suitably mounting the rail. If desired, the rail between the attaching regions can be offset so that the brackets can slide along the rail when it is mounted on a flat wall. The rail is also provided with one or more vertical grooves.

Brackets for supporting various devices include an arm section and an inverted U-shaped fastener section slidable along the rail. A protrusion provided at the junction of the arm and fastener section partially closes the U-shaped section to capture the bracket on the rail and permit the bracket to be slipped on and off the rail at the rail groove.

BRIEF DESCRIPTION OF THE DRAWINGS

The foregoing and other features of the present invention will be more readily apparent from the following detailed description and drawings of an illustrative embodiment of the invention in which.

DESCRIPTION OF AN EXEMPLARY EMBODIMENT

Figure 1:
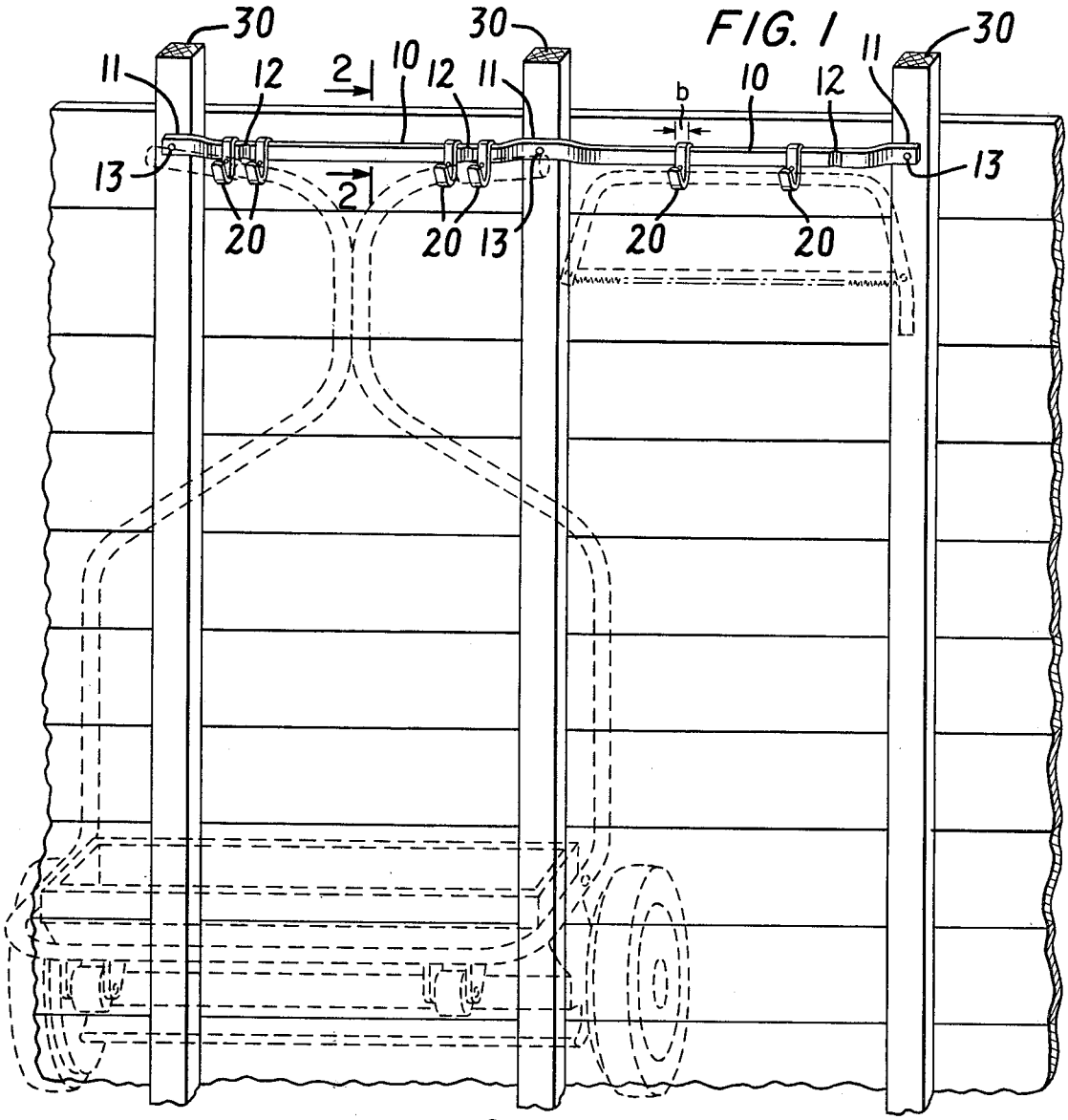
FIG. 1 is a perspective view of the wall storage system holding a lawn spreader and a saw.

In FIG. 1 a wall with exposed studs 30 is shown. Such a wall might be found in a garage, attic or storage room. Attached between the studs of the wall in a horizontal plane is a rail 10 with attaching regions 11 having apertures 13 permitting mounting of the rail to the studs at an appropriate height by suitable screws or nails. The attaching region can be about 16 inches apart, which is the normal spacing for wall studs.

In one embodiment the rail itself spans only one set of studs. In such a case several rails can be arranged end-to-end or one above the other to accommodate the various shapes of the items stored. However, a savings in mounting hardward and procedures can be realized when it is desired to span more than one set of studs, if the rail is made with attaching regions at its ends and also at the location of an intermediate stud, as shown in FIG. 1. With this arrangement, only three screws are needed as opposed to the four screws required for two shorter rails.

Figure 3:
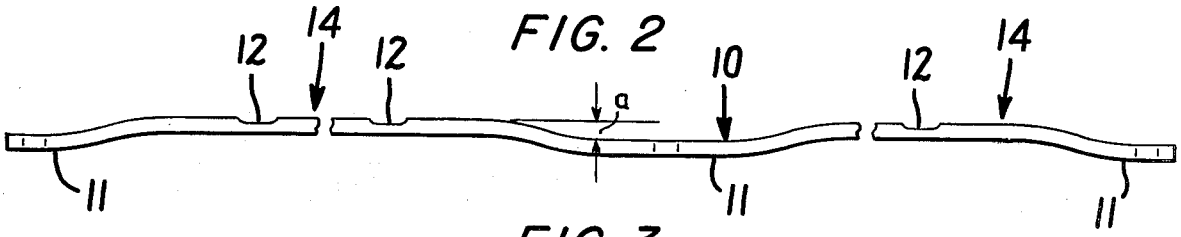
FIG. 3 is a top view of the mounting rail of FIG. 1.

Sections 14 of the rail extending from the attaching regions 11 are shown offset by dimension a in FIG. 3 to permit brackets 20 to slide along the rail when it is mounted to a wall whose studs are not exposed, but are covered by an inner wall. If desired, a straight rail can be used with exposed studs. Also, the rails include one or more vertical grooves 12.

Figure 2:
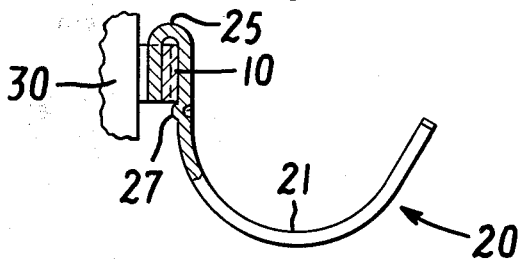
FIG. 2 is a side view of the wall system in the direction of arrows 2 in FIG. 1, partially in section.

As best seen in FIG. 2, the brackets 20 include a generally U-shaped arm section 21 that supports the stored implements, such as the lawn spreader and saw in FIG. 2. However, other convenient configurations for arm 21 can also be used. One end of the arm is connected to a fastener section 25, which has an inverted U-shape closely fitting the rail 10. A protrusion 27 at the open end of the fastener 25, adjacent its connection to the arm 21, acts to reduce the U-shaped opening of the fastener. The shape of the fastener and of the protrusion causes the bracket to grip the rail 10 and be captured thereby, but to remain freely slidable therealong. Also the width b of the fastener section (FIG. 1) together with its gripping of the rail minimizes wobbling of the bracket while permitting it to hold substantial loads.

In order to add or remove a bracket from the rail, the bracket is moved to one of the grooves 12. As shown in FIG. 2 in dotted line, the groove reduces the thickness of the rail to such an extent that the protrusion 27 no longer captures the bracket on the rail or prevents it from being added to the rail. In other words, the U-shaped fastener opening is substantially the same as the thickness of the rail at the groove to enable the bracket to be added or removed conveniently from the rail. As a result a wall storage system with great flexibility is created. The brackets can be added or removed and slid along the rail to accommodate a wide variety of loads. Also, once the bracket is slipped away from the groove, it is maintained on the rail in a stable fashion because of the design of its fastener.

While the invention has been particularly shown and described with reference to a preferred embodiment therefore, it will be understood by those skilled in the art that various changes in form and details may be made therein without departing from the spirit and scope of the invention.

I claim:

1. A wall storage system for storing loads of various shapes on a wall comprising:

an elongated rigid rail having regions adapted to be attached to the wall, said rail having a length, a width that is smaller than its length and a thickness that is smaller than the width, at least one transverse groove being formed across the entire width of the rail to reduce its thickness at the groove; and at least one rigid support bracket having an arm section integral with an inverted U-shaped fastener section closely fitting the rail, said fastener section, when attached to the rail, having an upper base portion and two leg portions extending downwardly from the base portion, the arm section being adapted to support the stored loads, a protrusion being provided on the bracket at the junction between the arm and fastener sections to reduce the U-shaped fastener opening between the two downwardly extending legs to less than the thickness of the rail, thereby capturing the bracket on the rail while permitting it to be moved along the rail to a desired position for supporting the selected load, the U-shaped fastener opening being of sufficient width to enable the bracket to be added to or removed from the rail at the groove.

2. A wall storage system as defined in claim 1 wherein the attaching regions are provided with apertures for mounting the rail to wall studs by means of fasteners, said attaching regions and apertures being spaced from each other by the average distance between wall studs.

3. A wall storage system as defined in claim 2 wherein the attaching regions and apertures are at the ends of the rail.

4. A wall storage system as claimed in claim 3 wherein the rail spans several wall studs and additional attaching regions and apertures are provided intermediate the ends of the rail at the positions of intermediate wall studs.

5. A wall storage system as defined in claim 1 wherein the rail includes a section offset with respect to the attaching regions.

6. A wall storage system as defined in claim 1 wherein the rail and the attaching region form a straight rail.

7. A wall storage system as defined in claim 1 wherein the arm section of the support bracket is U-shaped.

8. A wall storage system as defined in claim 1 wherein the protrusion is located on the bracket to cause the fastener to grip the rail.

* * * * *